US008419009B2

(12) United States Patent
Yoshii

(10) Patent No.: US 8,419,009 B2
(45) Date of Patent: Apr. 16, 2013

(54) SHEET FEEDER AND IMAGE FORMING APPARATUS USING THE SAME

(75) Inventor: Hajime Yoshii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 18 days.

(21) Appl. No.: 12/907,491

(22) Filed: Oct. 19, 2010

(65) Prior Publication Data

US 2011/0316220 A1 Dec. 29, 2011

(30) Foreign Application Priority Data

Jun. 25, 2010 (JP) ..... 2010-144438

(51) Int. Cl.
*B65H 3/14* (2006.01)

(52) U.S. Cl.
USPC ..... 271/97; 271/108; 271/94; 271/96

(58) Field of Classification Search ..... 271/97, 271/108, 94, 96, 98
See application file for complete search history.

(56) References Cited

U.S. PATENT DOCUMENTS

| | | | | |
|---|---|---|---|---|
| 6,015,144 | A | 1/2000 | Yoshii et al. | |
| 6,955,348 | B2 * | 10/2005 | Koga | 271/97 |
| 2005/0285326 | A1 * | 12/2005 | Uji et al. | 271/97 |
| 2009/0322013 | A1 * | 12/2009 | Shelhart | 271/97 |

FOREIGN PATENT DOCUMENTS

| | | | |
|---|---|---|---|
| JP | 11-005643 | A | 1/1999 |
| JP | 2002-128300 | A | 5/2002 |

* cited by examiner

*Primary Examiner* — Michael McCullough
*Assistant Examiner* — Howard Sanders
(74) *Attorney, Agent, or Firm* — Sughrue Mion, PLLC

(57) ABSTRACT

A sheet feeder includes a sheet stacking unit that stacks sheets, a sheet feeding unit that sequentially feeds the uppermost sheet of a stack of sheets stacked in the sheet stacking unit, an airflow supply unit that supplies an airflow to a side surface of the stack of sheets from an opening, a shield member that is disposed between the opening and the stack of sheets and a mechanism that changes the airflow from the airflow supply unit with respect to a stacking direction of the sheets by changing a relative position between the opening and the shield member in a direction other than the stacking direction of the sheets.

14 Claims, 7 Drawing Sheets

SHEET FEEDER AND IMAGE FORMING APPARATUS USING THE SAME

CROSS-REFERENCE TO RELATED APPLICATIONS

This application is based on and claims priority under 35 U.S.C. §119 from Japanese Patent Application No. 2010-144438 filed on Jun. 25, 2010.

BACKGROUND

Technical Field

The present invention relates to a sheet feeder and an image forming apparatus using the same.

SUMMARY

According to an aspect of the invention, there is provided a sheet feeder including:

a sheet stacking unit that stacks sheets;

a sheet feeding unit that sequentially feeds the uppermost sheet of a stack of sheets stacked in the sheet stacking unit;

an airflow supply unit that supplies an airflow to a side surface of the stack of sheets from an opening;

a shield member that is disposed between the opening and the stack of sheets; and a mechanism that changes the airflow from the airflow supply unit with respect to a stacking direction of the sheets by changing a relative position between the opening and the shield member in a direction other than the stacking direction of the sheets.

BRIEF DESCRIPTION OF THE DRAWINGS

Exemplary embodiments of the present invention will be described in detail based on the following figures.

FIG. 5A is a diagram schematically illustrating the configuration of the periphery of a shield member as viewed in the direction of V in FIG. 4 and FIG. 5B is a diagram illustrating the shield member;

FIG. 7A is a diagram illustrating an example where the shield member includes a curve, FIG. 7B is a diagram illustrating an example where the shield member includes a step shape, and FIG. 7C is a diagram illustrating an example where the shield member is provided with slits.

DETAILED DESCRIPTION

Hereinafter, exemplary embodiments of the invention will be described in detail with reference to the accompanying figures.

<Image Forming Apparatus 1>

Figure 1:
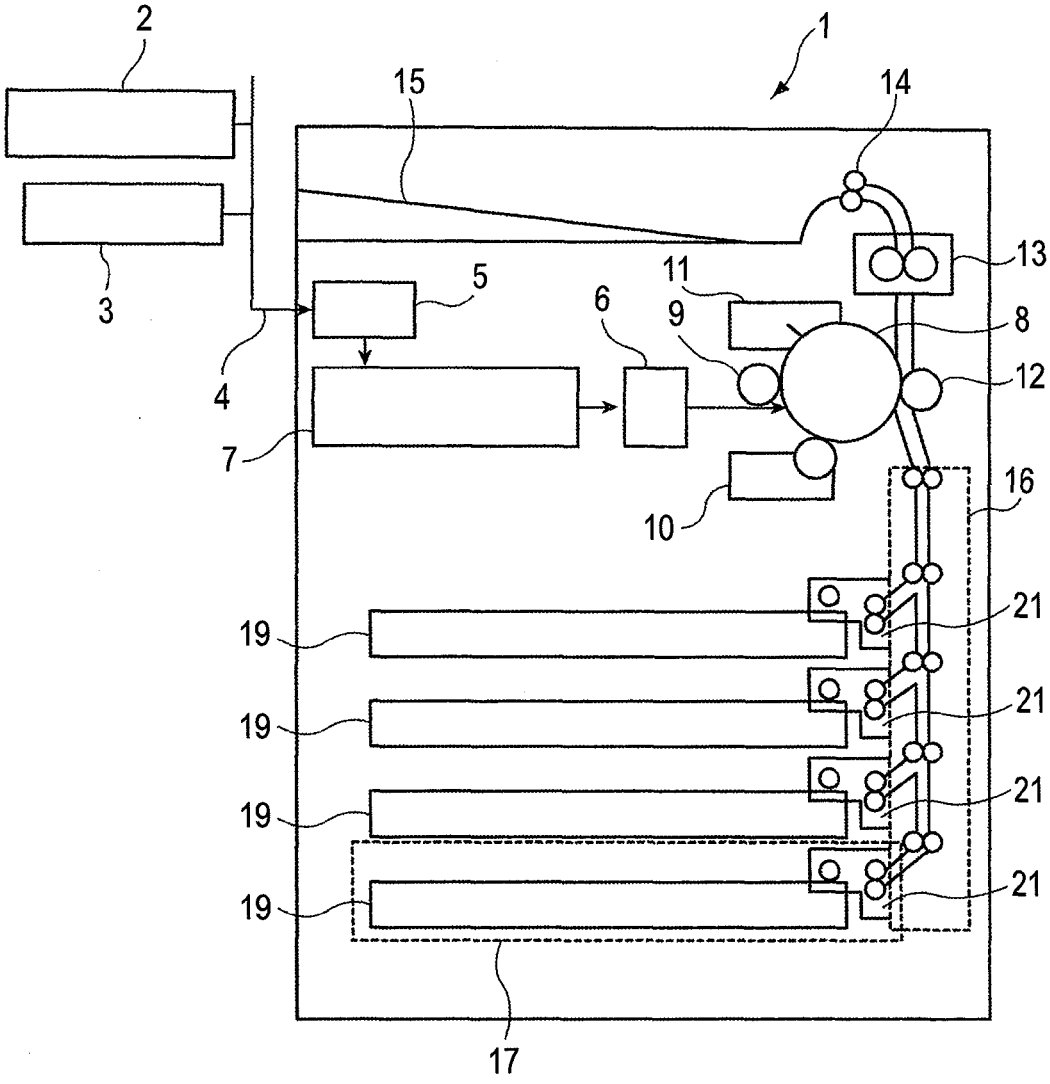
FIG. 1 is a diagram schematically illustrating a configuration of an image forming apparatus according to an exemplary embodiment of the invention.

An image forming apparatus 1 will be described with reference to FIG. 1. FIG. 1 is a diagram schematically illustrating a configuration of the image forming apparatus 1 according to an exemplary embodiment of the invention.

The image forming apparatus 1 shown in FIG. 1 includes an image reading device 2 such as a scanner reading an image, an external device 3 such as a personal computer (PC), a receiver 5 connected to the image reading device 2, the external device 3 and the like via a communication line 4, and an image recording controller 7 receiving image information from the receiver 5 and controlling the image forming apparatus 1 as a whole. The image recording controller 7 outputs, for example, a feeding start signal, details of which will be described later.

The image forming apparatus 1 further includes an image writing device 6 writing an image on the basis of the image information received by the image recording controller 7, a cylindrical image holder 8 to which an electrostatic latent image is written by the image writing device 6, a charging device 9 disposed in a circumferential direction of the image holder 8, and an image developing device 10 developing the electrostatic latent image written to the image holder 8 using toner. The image forming apparatus 1 further includes a cleaner 11 removing toner remaining on the image holder 8, a transfer roller 12 transferring an image formed on the image holder 8 to a sheet S, a fixing device 13 fixing the image transferred to the sheet S, a discharge roller 14 discharging the sheet S from the fixing device 13 and a discharging sheet stacking unit 15 on which the sheet S discharged by the discharge roller 14 are stacked.

The image forming apparatus 1 further includes plural sheet supply devices 17 supplying sheets S to the image holder 8 and the transfer roller 12 via a sheet transporting unit 16.

<Sheet Supply Device 17>

Figure 2:
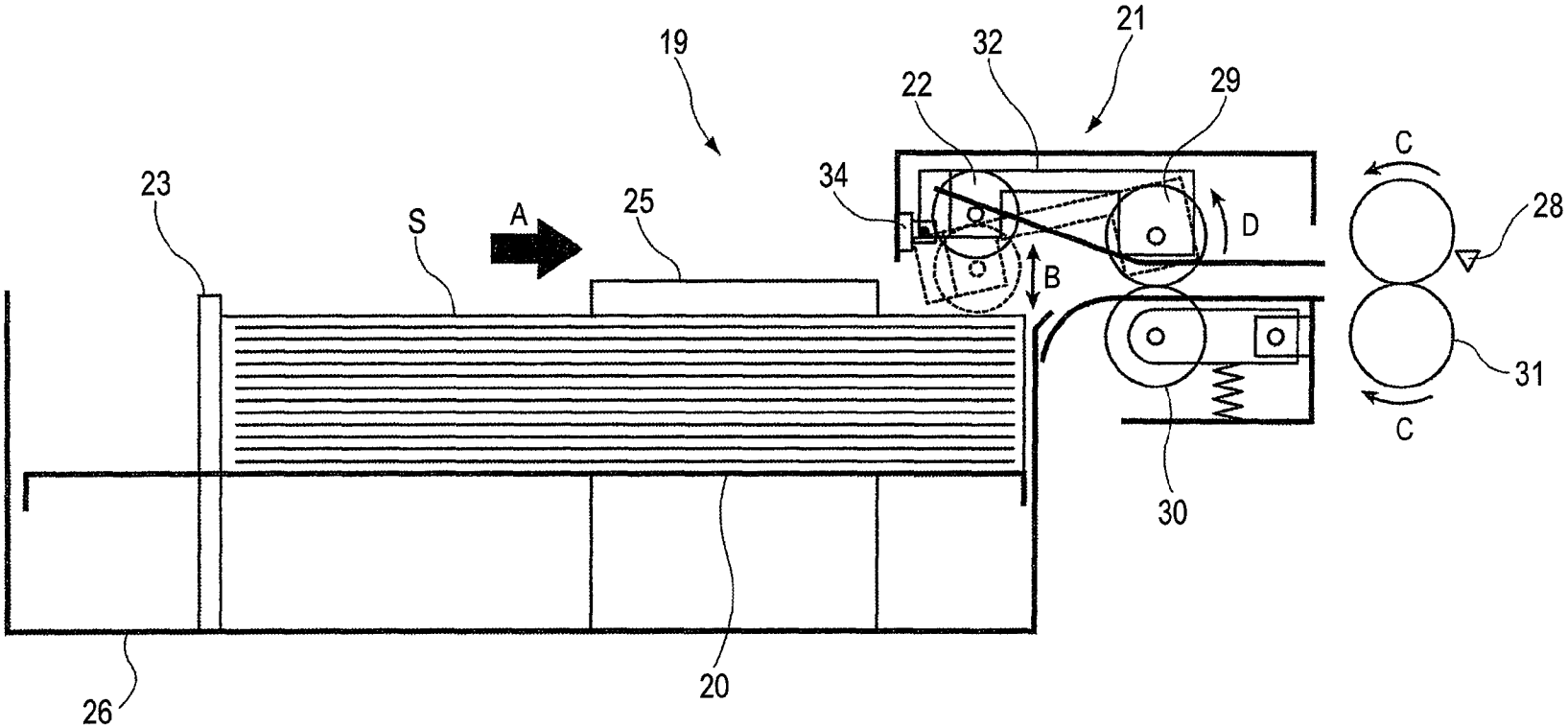
FIG. 2 is a schematic front view of a sheet feeder according to the exemplary embodiment of the invention.
Figure 3:
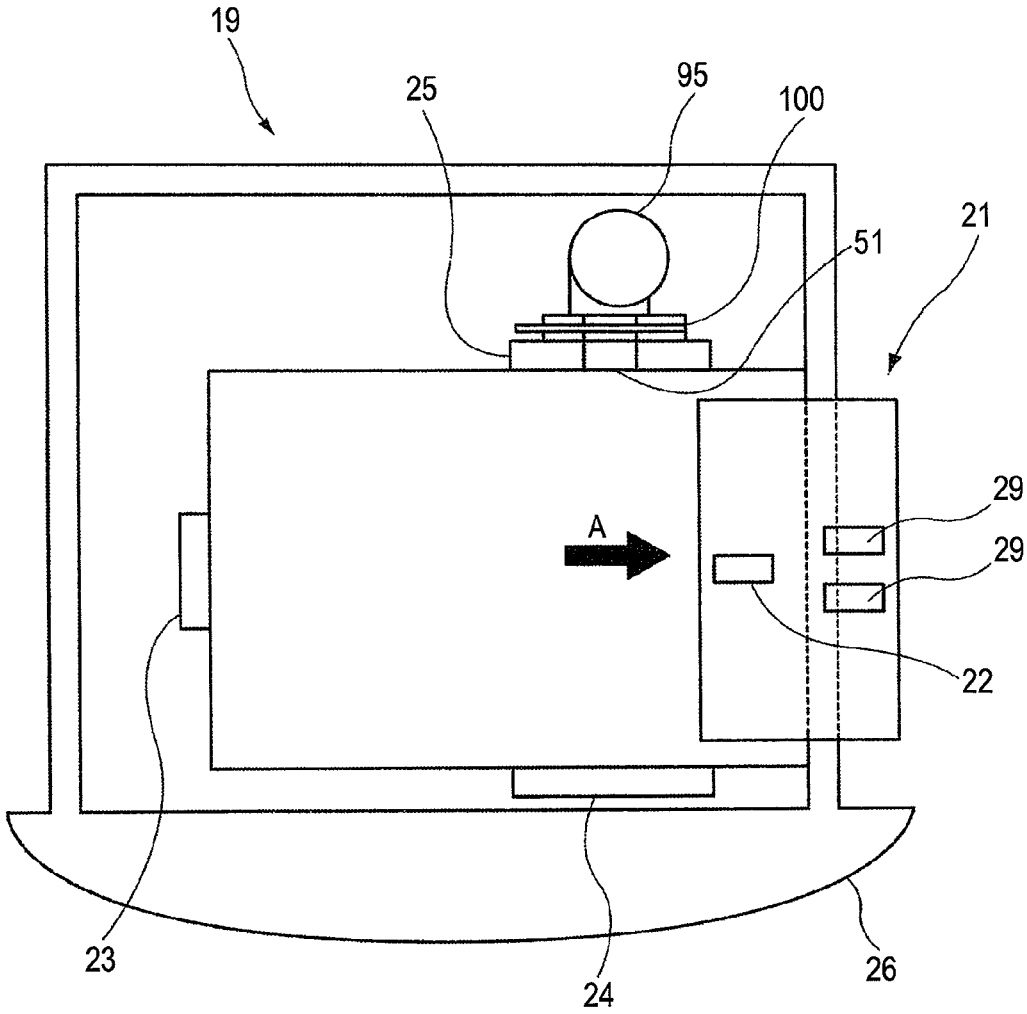
FIG. 3 is a schematic top view of the sheet feeder according to the exemplary embodiment of the invention.

The sheet supply device 17 will be described below with reference to FIGS. 2 and 3. Here, FIG. 2 is a schematic front view of the sheet supply device 17 according to this exemplary embodiment of the invention and FIG. 3 is a schematic top view of the sheet supply device 17 according to this exemplary embodiment of the invention.

Each sheet supply device 17 includes a feeding sheet stacking unit 19 in which sheets S are stacked in good order and a sheet feeding unit 21 sequentially feeding the sheets S stacked in the feeding sheet stacking unit 19 from the uppermost to the image holder 8.

Here, the feeding sheet stacking unit 19 and the sheet feeding unit 21 will be described in more detail. The sheet feeding unit 21 will be first described and the feeding sheet stacking unit 19 will then be described.

<Sheet Feeding Unit 21>

The sheet feeding unit 21 includes a pickup roller 22 sequentially feeding the sheets S, a feed roller 29 and a retard roller 30 disposed downstream in a feeding direction (see arrow A) of the sheets of paper S relative to the pickup roller 22, a pair of takeaway rollers 31 disposed downstream in the feeding direction of the sheets S relative to the feed roller 29 and the retard roller 30, a feed motor (not shown) connected to the pickup roller 22, the feed roller 29 and the retard roller 30 to supply driving power thereto, a level sensor 34 sensing height of the stack of the sheets S in the stacking direction, and a feedout sensor 28 sensing pass of the sheets S.

The respective members will be described below.

First, the pickup roller 22 is rotatably provided so as to feed the sheets S in the feeding direction (see arrow A). The pickup roller 22 is also disposed to be capable to swing (see arrow B) via a support arm 32 due to a solenoid (not shown).

The level sensor 34 is disposed at a position facing a part of the pickup roller 22 and senses height of the stack of sheets S stacked on a bottom plate 20 by detecting a position of the pickup roller 22.

The feed roller 29 is disposed downstream in the feeding direction relative to the pickup roller 22 so as to be rotatable in the feeding direction (see arrow D), and feeds the sheet S from the pickup roller 22 to the downstream side in the feeding direction.

The retard roller 30 is disposed downstream in the feeding direction relative to the pickup roller 22 so as to face the feed roller 29 and rotates in both the feeding direction and the anti-feeding direction opposite to the feeing direction. A torque having a predetermined limit is applied to the retard roller 30 from a torque limiter (not shown) in the anti-feeding direction.

The pair of takeaway rollers 31 are disposed downstream in the feeding direction relative to the feed roller 29 and the retard roller 30 to face each other. The pair of takeaway rollers 31 are rotatable in the feeding direction (see arrow C) and transport the sheet S from the feed roller 29 to the downstream side.

<Feeding Sheet Stacking Unit 19>

Figure 4:
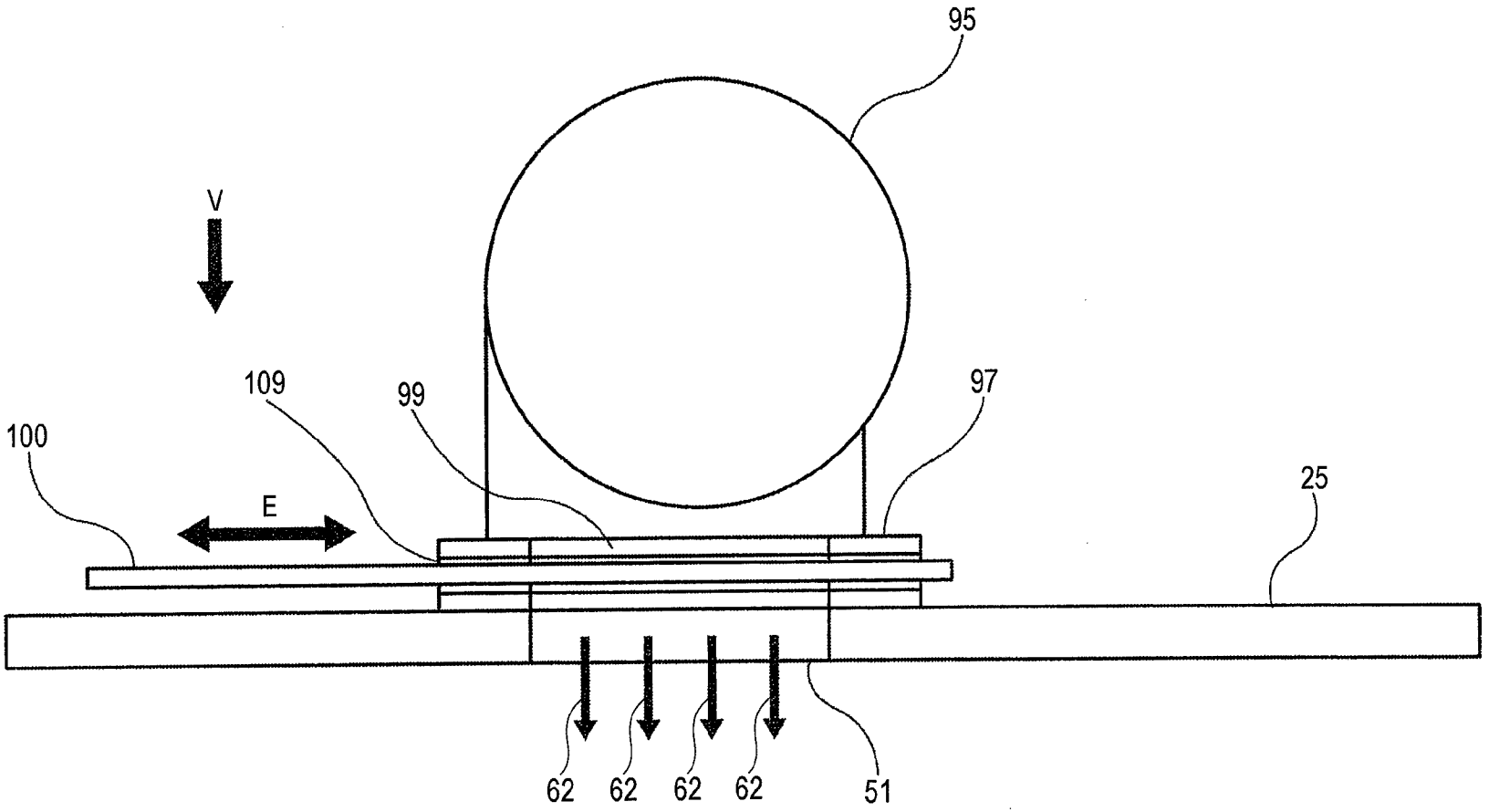
FIG. 4 is a schematic top view of a blower and an air adjusting unit according to the exemplary embodiment of the invention.
Figure 5A:
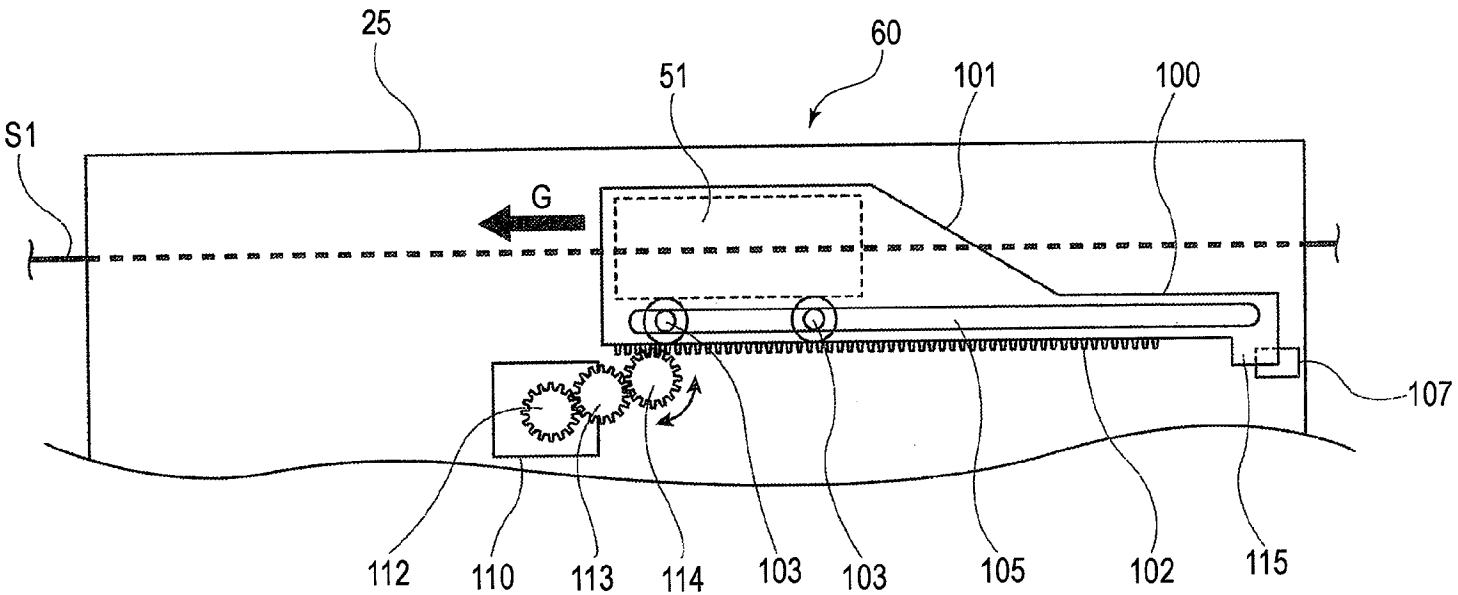
FIGS. 5A and 5B are schematic diagrams of the air adjusting unit according to the exemplary embodiment of the invention, where
Figure 5B:
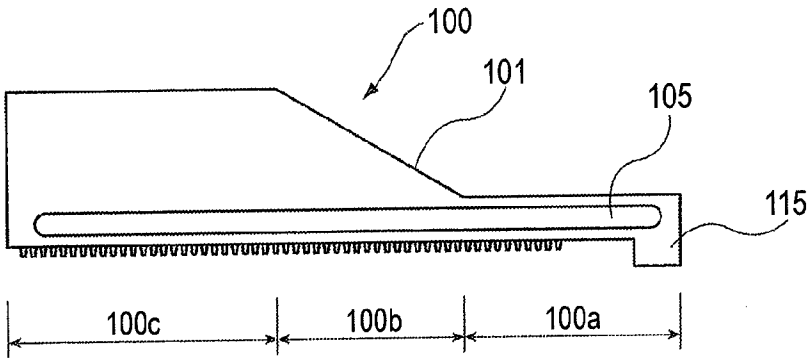

The feeding sheet stacking unit 19 will be described below with reference to FIGS. 2 to 5B. FIG. 4 is a schematic top view illustrating the periphery of a blower 95 and an air adjusting unit 60 according to this exemplary embodiment of the invention. FIGS. 5A and 5B are schematic diagrams of the air adjusting unit 60 according to this exemplary embodiment of the invention, where FIG. 5A is obtained by rotating by 180° a schematic diagram illustrating a configuration of the periphery of a shield member 100 as viewed in the direction of arrow V in FIG. 4 and FIG. 5B is a diagram illustrating the shield member 100. In FIGS. 5A and 5B, the blower 95 and a nozzle 97 are not shown for the purpose of simplicity and the sheets S other than the uppermost sheet S1 are not shown.

The feeding sheet stacking unit 19 includes a feeding container 26 in which a stack of sheets S is disposed, the bottom plate 20 disposed on the bottom of the feeding container 26 to stack the sheets S thereon, a wire (not shown) of which an end is connected to the bottom plate 20, a bottom plate motor (not shown) connected to the other end of the wire, and an end guide 23, a first side guide 24, and a second side guide 25 limiting movement of the stack of sheets S stacked on the bottom plate 20. The feeding sheet stacking unit 19 further includes the blower 95 blowing air to the side surface of the stack of sheets S and the air adjusting unit 60 adjusting the air blown from the blower 95.

The respective members will be described below.

First, the end guide 23 will be described. The end guide 23 is disposed to come in contact with an end of the sheets S stacked on the bottom plate 20, which is an end in the anti-feeding direction. The end guide 23 includes a surface along the stacking direction of the sheets of paper S so as to arrange the ends of the sheets S stacked on the bottom plate 20. The end guide 23 may be movable depending on the size of the stacked sheets S.

Next, the first side guide 24 and the second side guide 25 will be described.

The first side guide 24 and the second side guide 25 are disposed to come in contact with ends of the sheets S stacked on the bottom plate 20, which are two ends in the feeding direction of the sheets S. More specifically, the first side guide 24 and the second side guide 25 are opposed to each other with interposing the bottom plate 20 therebetween. For example, in FIG. 2, the first side guide 24 is disposed in a front side of the figure surface relative to the sheets S in FIG. 2 (the first side guide 24 is not shown in FIG. 2) and the second side guide 25 is disposed in a rear side of the figure surface relative to the sheets S in FIG. 2.

The first side guide 24 and the second side guide 25 have a surface along the stacking direction of the sheets S so as to align the ends of the stack of sheets S stacked on the bottom plate 20. Both or one of the first side guide 24 and the second side guide 25 may be movable in accordance with the size of the sheets S to be stacked.

The second side guide 25 includes an air blowing port 51 formed to pass from the surface of the second side guide 25 coming into contact with the stack of sheets S to the surface opposite to the surface coming contact with the sheets S and opened to the side surface of the stack of sheets S. The air blowing port 51 is disposed to supply air to the uppermost sheet S1 in the stack of sheets S.

Next, the blower 95 will be described.

The blower 95 is disposed at a position opposed to the second side guide 25 so as to blow air to the side surface of the stack of sheets S via the air blowing port 51.

More specifically, the blower 95 includes blades (not shown) disposed therein so as to generate air by rotation and a nozzle 97 discharging the air generated by the blades in a direction outside the blower 95. An opening 99 opposed to the air blowing port 51 is formed in the nozzle 97. By opposing the air blowing port 51 and the opening 99 to each other, an air flow path 62 from the blower 95 to the stack of sheets S is formed.

In this example, the shape of the opening 99 of the nozzle 97 is equal to the shape of the air blowing port 51 and the opened portions thereof correspond to each other (see FIG. 4). Accordingly, the air blown from the blower 95 can pass through the air blowing port 51 without any hindrance.

Next, the air adjusting unit 60 will be described.

The air adjusting unit 60 is disposed between the second side guide 25 and the blower 95.

The air adjusting unit 60 in this exemplary embodiment includes the shield member 100 disposed to be movable so as to intersect the air flow path 62, a driving unit driving the shield member 100, a photo sensor 107 sensing the movement of the shield member 100, and a support member 109 supporting the air adjusting unit 60. Here, the driving unit includes a driving motor 110 supplying power for moving the shield member 100, a driving gear 112, a first transmission gear 113 and a second transmission gear 114 transmitting the power generated by the driving motor 110 to the shield member 100, and a guide pin 103 disposed in the second side guide 25 so as to guide the moving direction of the shield member 100.

The respective members will be described below.

First, the shield member 100 serves as a shutter opening and closing the air blowing port 51 to open and close the air flow path 62 passing through the air blow port 51. Specifically, the shield member 100 is formed of a plate-like member having a surface extending in the direction intersecting the air flow path 62. The shield member 100 moves back and forth between the nozzle 97 of the blower 95 and the second side guide 25. More specifically, the shield member 100 is disposed to be movable back and forth in the direction intersecting the air flow path 62, that is, the direction (hereinafter, referred to as "sheet end direction": see arrow E in FIG. 4) along the end, which is close to the side guide, of the sheets S stacked on the bottom plate 20.

The shield member 100 is divided into three portions: a small-width portion 100*a*, an inclined portion 100*b*, and a large-width portion 100*c* in accordance with the width (the height in the vertical direction in FIG. 5) in the stacking direction of the sheets S. That is, as shown in FIG. 5B, the shield member 100 includes the small-width portion 100*a* which is one end portion of the shield member 100 in the sheet end direction and which has a small width in the stacking direction of the sheets S, the large-width portion 100*c* which is the other end portion of the shield member 100 in the sheet end direction and which has a large width in the stacking direction of the sheets S, and the inclined portion 100*b* which is disposed between the small-width portion 100*a* and the large-width portion 100*c* and in which the width in the stacking direction of the sheets S varies. As described later, as the shield member 100 moves in the sheet end direction, the large-width portion 100*c*, the inclined portion 100*b* and the small-width portion 100*a* oppose to the air blowing port 51.

Here, as shown in FIG. 5B, a lower end of the shield member 100 is straightly linear except for a light-blocking portion 115 to be described later.

On the other hand, an upper end of the shield member 100 is not linear but becomes close to the lower end of the shield member 100 in the order of the large-width portion 100*c*, the inclined portion 100*b* and the small-width portion 100*a*. More specifically, the distance between the upper end of the shield member 100 and the lower end thereof is constant in the large-width portion 100*c* and the small-width portion 100*a*. On the contrary, the distance therebetween varies in the inclined portion 100*b* and the inclined portion is formed by connecting the upper end of the small-width portion 100*a* in the stacking direction of the sheets S to the upper end of the large-width portion 100*c* with a straight line intersecting the stacking direction of the sheets S.

The large-width portion 100*c* of the shield member 100 is disposed at the position opposed to the air blowing port 51 to block the air flow path 62. The small-width portion 100*a* of the shield member 100 is disposed at the position opposed to the air blowing port 51 not to block the air flow path 62.

The shield member 100 is provided with a guide slit 105 at a position close to the bottom plate 20 in the stacking direction of the sheets S. The guide slit 105 extends in the sheet end direction. Two guide pins 103 formed in the second side guide 25 are located in the guide slit 105, whereby a locus of the shield member 100 in the sheet end direction is regulated.

The shield member 100 further includes a rack gear 102 at the end close to the bottom plate 20. The rack gear 102 extends in the sheet end direction and converts the power supplied from the driving motor 110 into power for moving the shield member 100 in a linear direction as described later.

The shield member 100 further includes a light-blocking portion 115 at an end close to the small-width portion 100*a* and at a position opposed to the photo sensor 107. By causing the photo sensor 107 to sense the position of the light-blocking portion 115, it is detected that the shield member 100 blocks the air flow path 62.

The driving motor 110 and the like will be described below.

The driving motor 110 supplying power to cause the shield member 100 to move includes a driving shaft and the driving gear 112 is disposed at the same axis as the driving shaft. The first transmission gear 113 is disposed to engage with the driving gear 112 and the second transmission gear 114 is disposed to engage with the first transmission gear 113. The second transmission gear 114 is disposed to engage with the rack gear 102 disposed in a lower surface of the shield member 100. In this way, the driving power of the driving motor 110 is transmitted to the shield member 100.

<Operation of Sheet Feeder 17>

Figure 6:
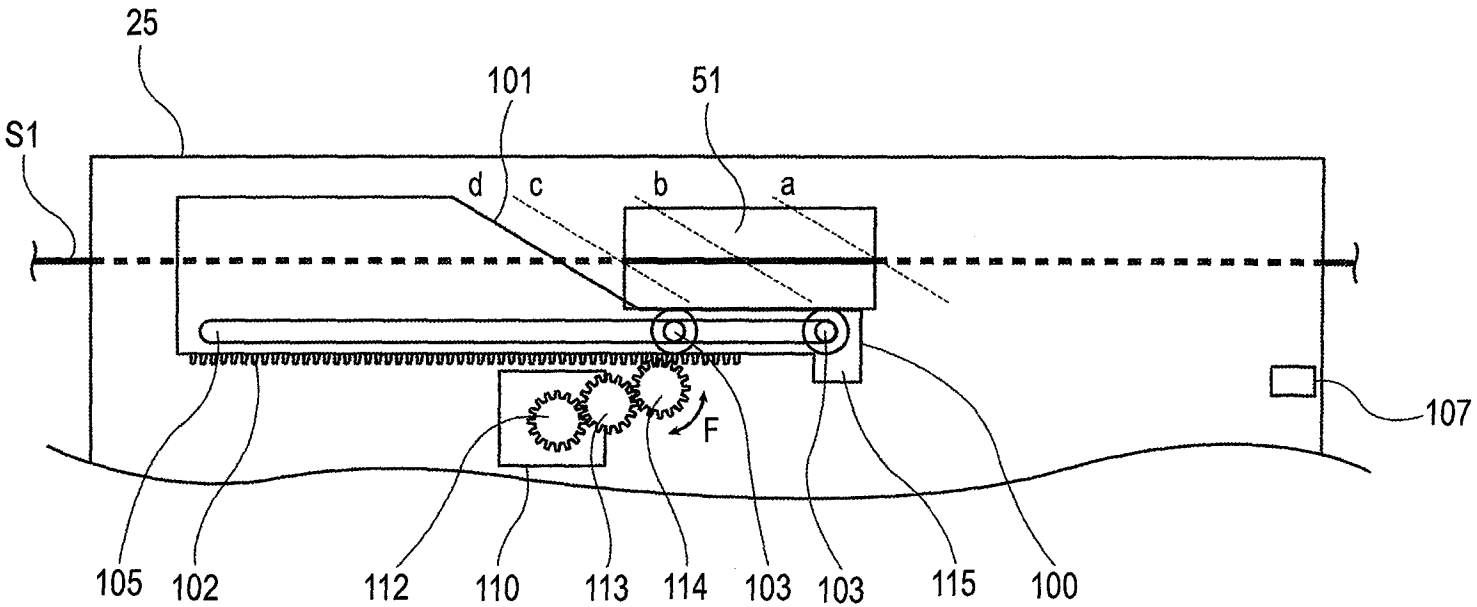
FIG. 6 is a diagram schematically illustrating the configuration of the periphery of the shield member when an air blowing port is opened.

Operations of a sheet feeding method in the sheet feeder 17 will be described with reference to FIG. 6. FIG. 6 is a diagram schematically illustrating the configuration of the periphery of the shield member 100 in which the air blowing port 51 is opened. In FIG. 6, the sheets S other than the uppermost sheet S1 among the sheets S is not shown for the purpose of simplification.

First, the operation states of the sheet feeder 17 include a standby state where the sheet feeder 17 is not driven, a driving state where the sheet feeder 17 is driving, and a sheet-out state where no sheet S is stacked in the sheet feeder 17. The respective states will be described below.

First, in the sheet-out state of the sheet feeder 17, no sheet S is stacked in the feeding container 26, and the pickup roller 22 pressed down by a solenoid (not shown) is lowered and is located at the position indicated by a dashed line in FIG. 2.

Next, the standby state will be described. The sheets S are fed so as to change the sheet feeder 17 from the sheet-out state to the standby state. Specifically, when the sheets S are stacked on the bottom plate 20 of the feeding container 26 taken out of the image forming apparatus 1 in order to feed the sheets S and the feeding container 26 is inserted into the image forming apparatus 1, a bottom-plate motor (not shown) is driven. By winding a wire (not shown) on the driving shaft of the bottom-plate motor, the bottomplate 20 is raised. Then, the uppermost sheet S1 in the stack of sheets S is disposed to come in contact with the pickup roller 22 pressed down by the solenoid (not shown). The pickup roller 22 is raised by bringing the sheets S into contact with the pickup roller 22. The level sensor 34 sensing the rising of the pickup roller 22 outputs a detection signal so that the bottom-plate motor (not shown) and the solenoid (not shown) are turned off on the basis of the detection signal. This state is the standby state of the sheet feeder 17.

In the sheet-out state and the standby state, the members of the sheet feeder 17 operate as follows. That is, the blower 95 is turned off and the driving motor 10 is also turned off. The shield member 100 is disposed to oppose the large-width portion 100*c* to the air blowing port 51 to block the air blowing port 51. That is, the air flow path 62 is blocked by the shield member 100 (see FIG. 5A). The light-blocking portion 115 blocks the optical axis of the photo sensor 107. The reason that the shield member 100 blocks the air blowing port 51 in the sheet-out state and the standby state is to prevent from particles, wastes, and dust from entering the air blowing port 51.

The operation of the sheet feeder 17 in the driving state will be described below.

Here, the operation of the shield member 100 of the sheet feeder 17 will be first described and then the entire operations of the sheet feeder 17 will be described.

The operation of the shield member 100 is described. First, using a feed start signal output from the image recording controller 7 as a trigger, the driving motor 110 rotationally drives the driving gear 112 in the CCW (counter clock wise) direction in FIGS. 5A and 5B. By the rotation of the driving motor 110, the shield member 100 starts moving to the left side (see arrow G) in FIGS. 5A and 5B. That is, the shield member 100 starts moving to cause the inclined portion 100*b* and the small-width portion 100*a* to oppose to the air blowing port 51. As the shield member 100 moves, the closed air blowing port 51 is sequentially opened.

Specifically, when the inclined portion 100*b* of the shield member 100 is located at the position a in FIG. 6, the air blowing port 51 is sequentially opened from an upper corner of the right end thereof. That is, the air blowing port 51 is opened from the opposite side (see arrow G) of the side to which the shield member 100 moves and from the upside in the stacking direction of the sheets S.

As the shield member 100 moves to positions b and c in FIG. 6, the area for blowing air is widened from the upside in the stacking direction of the sheets S to the downside. As the shield member 100 moves, the air is blown widely to the upper sheets of the stacked sheets S in the sheet end direction. Accordingly, the sheets S in the stack can easily waft to be separated from the upside.

When the shield member 100 moves to the position d, the air is blown through the entire opening of the air blowing port 51. That is, the entire air flow path 62 is opened.

The operation of the shield member 100 will be continuously described. When the shield member 100 reaches the position d, the driving motor 110 is temporarily stopped.

The shield member 100 starts moving in the direction opposite to arrow G in FIGS. 5A and 5B. More specifically, the driving motor 110 rotationally drives the driving gear 112 in the CW (clockwise) direction in FIGS. 5A and 5B so that the shield member 100 moves to the right side in FIGS. 5A and 5B, whereby the inclined portion 100*b* sequentially blocks the air blowing port 51. After moving to the positions c, b, and a in FIG. 6, the large-width portion 100*c* is opposed to the air blowing port 51 and the light-blocking portion 115 stops at the position where a signal from the photo sensor 107 is blocked.

The sheet feeder 17 repeatedly performs the above-mentioned operation during the feeding operation, that is, the sheet feeder 17 moves back and forth along the sheet end direction, whereby the upper sheets S in the stack of sheets can be kept separated.

The entire operation of the sheet feeder 17 will be described below.

First, using the feed start signal output from the image recording controller 7 as a trigger, the blower 95 is driven and the sheet feeding unit 21 is driven. Accordingly, the uppermost sheet S1 in the stack of sheets S is picked up to be separated, and then fed in the feeding direction. As described above, using the feed start signal output from the image recording controller 7 as a trigger, the shield member 100 also starts moving to the left side (see arrow G) in FIGS. 5A and 5B.

The operation of the sheet feeding unit 21 will be described in detail.

First, using the feed start signal output from the image recording controller 7 as a trigger, the pickup roller 22, the feed roller 29 and the retard roller 30 are rotated by the feed motor (not shown). Then, the uppermost sheet S1 picked up by the pickup roller 22 is separated and transported by the feed roller 29 and the retard roller 30 disposed downstream in the feeding direction relative to the pickup roller 22. That is, the feed roller 29 rotating in the feeding direction (see arrow D) and the retard roller 30 rotatable in both directions with application of a torque having a predetermined limit from the torque limiter (not shown) in the anti-feeding direction come in contact with each other with a predetermined pressure so that the sheets S are separated and transported by an interaction therebetween. The retard roller 30 rotates in the feeding direction when only one sheet S exists in the contact portion with the feed roller 29, and rotates in the anti-feeding direction when two or more sheets exist therein.

The sheet S fed in the feeding direction by the feed roller 29 and the retard roller 30 is further transported downstream by the takeaway roller 31. The transportation of the sheet S is detected by the feedout sensor 28. When the sheet S is being transported by the takeway roller 31, the feed roller 29 is stopped driving so that the feed roller 29 rotates with a one-way clutch (not shown).

When the sheets S in the stack are sequentially fed from the upside, the sheet feeder 17 moves back and forth in the sheet end direction as described above, whereby the upper sheets S in the stack can be kept separated.

When the feeding operation is repeated, the height of the stack of sheets S is sequentially lowered and the height of the pickup roller 22 upon pressing is lowered. Accordingly, the level sensor 34 detects the support arm 32 of the pickup roller 22 (receives light), the bottom plate 20 is raised by the bottom-plate motor (not shown), and the feeding operation is continuously performed.

By repeatedly performing the above-mentioned operations, all the sheets S on the bottom plate 20 are fed out and the sheet-out state is reach again.

In the configuration according to this exemplary embodiment, it is possible to prevent the uppermost sheet S1 in the stack of sheets S and one or more sheets S therebelow from being picked up together. The configuration according to this exemplary embodiment exhibits a remarkable effect, for example, when special sheets such as coated sheets are used, when the surface of the sheet S is viscous and the like.

Since the shield member 100 according to this exemplary embodiment includes the inclined portion 100*b*, the shield member 100 moves in a direction intersecting the stacking direction of the sheets S. Accordingly, compared with the case where the shield member 100 moves in the stacking direction of the sheets S, it is possible to lower the height of the sheet feeder 17. In addition, since the shield member 100 is disposed at a side of the stack of sheets S, it is possible to reduce the size of the image forming apparatus 1 including the shield member 100.

Figure 7A:
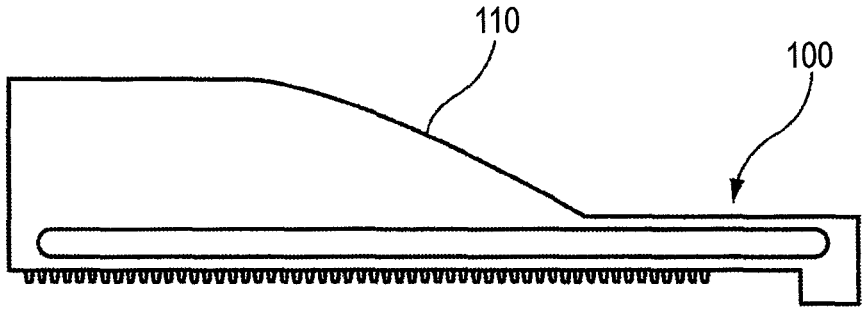
FIGS. 7A to 7C are front views illustrating other examples of the shield member according to the exemplary embodiment of the invention, where
Figure 7B:
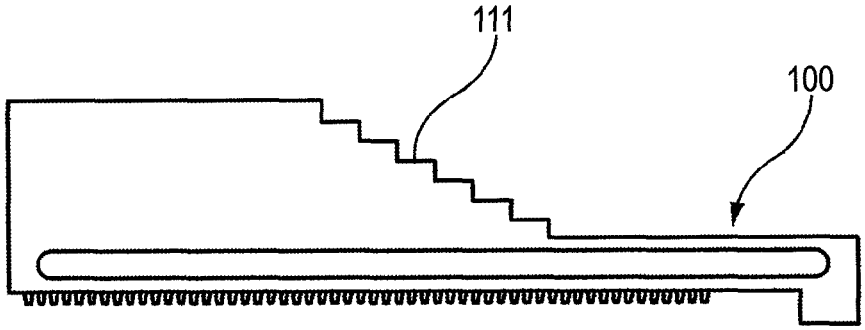
Figure 7C:
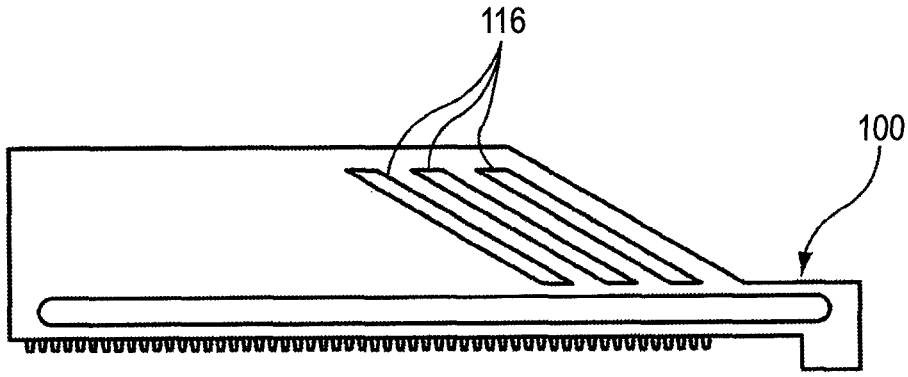

Here, the shield member 100 according to this exemplary embodiment is not limited to the above-mentioned configuration. Other configurations will be described with reference to FIGS. 7A to 7C. FIGS. 7A to 7C are front views illustrating other configurations of the shield member 100 according to the exemplary embodiment of the invention, where FIG. 7A is a diagram illustrating the inclined portion 100*b* with a curve, FIG. 7B is a diagram illustrating the inclined portion 100*b* has a step shape, and FIG. 7C is a diagram illustrating the shield member 100 provided with slits.

First, as shown in FIGS. 7A and 7B, the inclined portion 100*b* of the shield member 100 may have a curved shape or a step shape. That is, a connecting portion 101 of the shield member 100 has only to have such a shape to change the height of the opened portion of the air blowing port 51 in the stacking direction of the sheets S as the shield member 100 moves.

More specifically, for example, as shown in FIG. 7A, the connecting portion 101 of the shield member 100 may have a shape obtained by connecting the upper end of the small-width portion 100*a* in the stacking direction of the sheets S to the upper end of the large-width portion 100*c* in the stacking direction of the sheets S with a curve. Here, the connecting portion has a curve which is convex to the upside in FIG. 7A. When the inclined portion 100*b* of the shield member 100 has a curve convex to the upside, the area for blowing air to the upper sheets S is widened and the reliability in separating the sheets S is improved.

For example, as shown in FIG. 7B, the connecting portion 101 of the shield member 100 may have a shape obtained by connecting the upper end of the small-width portion 100*a* in the stacking direction of the sheets S to the upper end of the large-width portion 100*c* in the stacking direction of the sheets S having the step shape.

When the inclined portion 100*b* of the shield member 100 has the step shape, the opened portion of the air blowing port 51 discontinuously varies as the shield member 100 moves, whereby the reliability in separating the sheets S is further improved.

As shown in FIG. 7C, the inclined portion 100*b* of the shield member 100 may include plural linear portions. Specifically, the inclined portion 100*b* may be provided with plural air slits 116. Here, the air slit 116 is the opening 99 passing from the sheets S to the blower 95 and the opening 99 has a linear portion inclined relative to the stacking direction of the sheets S.

When the inclined portion 100*b* of the shield member 100 is provided with plural air slits 116, a portion passing air and a portion blocking air alternately face the air blowing port 51 as the shield member 100 moves. Accordingly, the air blown to the sheets S can be changed, thereby further improving the reliability in separating the sheets S.

Although it is described above that the shield member 100 moves relative to the blower 95, the blower 95 may move relative to the shield member 100 or both the shield member 100 and the blower 95 may move. More specifically, the rack gear 102 may be disposed in the blower 95 so as to transmit the driving power of the driving motor 110.

Although the relation of the air blowing port 51 disposed in the second side guide 25 and the inclined portion 100*b* of the shield member 100 is described above, the relation of the opening 99 of the blower 95 and the inclined portion 100*b* of the shield member 100 is the same as described above. That is, as the inclined portion 100*b* of the shield member 100 moves, the height of the opened portion of the opening 99 of the blower 95 in the stacking direction of the sheets S varies. Since the opening 99 of the blower 95 and the air blowing port 51 of the second side guide 25 are provided, it is possible to surely switch the portion passing air and the portion blocking the air, compared with the case where one of the opening 99 of the blower 95 and the air blowing port 51 of the second side guide 25 is provided.

In the invention, only one of the opening 99 of the blower 95 and the air blowing port 51 of the second side guide 25 may be provided.

Although it is described above that the sheet feeder 17 is disposed in the lower portion of the image forming apparatus 1, the invention is not limited to this configuration. For example, the sheet feeder 17 may be disposed on the side of the image forming apparatus 1. Alternatively, for example, a manual sheet stacking unit may be disposed on the side of the image forming apparatus 1 and the sheet feeder 17 may be disposed in the manual sheet stacking unit. Alternatively, the sheet feeder 17 may be provided as a body separated from the image forming apparatus 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeder comprising:

a sheet stacking unit that stacks sheets;

a sheet feeding unit that sequentially feeds the uppermost sheet of a stack of sheets stacked in the sheet stacking unit;

an airflow supply unit that supplies an airflow to a side surface of the stack of sheets from an opening which is opposed to the side surface of the stack of sheets;

a shield member that is disposed between the opening and the stack of sheets; and a mechanism that changes a relative position between the opening and the shield member in a direction other than a stacking direction of the sheets to change a stream of the airflow from the airflow supply unit toward a direction intersecting a stacking direction of the sheets, wherein the mechanism moves the shield member by rectilinear movement.

2. The sheet feeder according to claim 1, wherein the shield member includes an inclined portion that partially blocks the airflow from the airflow supply unit and that is inclined with respect to the stacking direction of the sheets.

3. The sheet feeder according to claim 2, wherein the shield member is provided with a slit formed in the inclined portion thereof to pass the airflow from the airflow supply unit.

4. The sheet feeder according to claim 1, wherein the shield member is a plate-like member that extends in a direction in which the mechanism moves.

5. The sheet feeder according to claim 1, wherein the mechanism moves back and forth in a direction intersecting the stacking direction of the sheets.

6. The sheet feeder according to claim 1, wherein the mechanism moves the shield member so that a side of the shield member facing the sheet stack moves in a direction parallel to the a sheet end direction on a side of the stack of sheets which receive the air flow.

7. An image forming apparatus comprising:

an image forming unit that forms an image on a sheet;

a sheet stacking unit that stacks sheets to be fed to the image forming unit;

a sheet feeding unit that sequentially feeds the uppermost sheet of a stack of sheets stacked in the sheet stacking unit to the image forming unit;

an airflow supply unit that supplies an airflow to a side surface of the stack of sheets from an opening which is opposed to the side surface of the stack of sheets;

a sheet end guide that is disposed between the airflow supply unit and the stack of sheets, the sheet end guide including an airflow blowing port formed to pass the airflow from the airflow supply unit to the side surface of the stack of sheets and a surface provided along the stacking direction of the sheets to align ends of the stacked sheets; and a shield member that is disposed between the sheet end guide and the airflow supply unit and moves to change a relative position between the opening and the shield member in a direction other than the stacking direction of the sheets to change a stream of airflow from the airflow supply unit toward a direction intersecting the stacking direction of the sheets, wherein the shield member moves by rectilinear movement.

8. The sheet feeder according to claim 1, wherein the shield member moves in a direction intersecting a direction of the airflow from the supply unit.

9. The sheet feeder according to claim 8, wherein the direction in which the shield member moves is orthogonal to the direction of the airflow from the supply unit.

10. The sheet feeder according to claim 1, wherein the shield member moves in a direction parallel to a sheet end direction on a side of the stack of sheets which receive the air flow.

11. The image forming apparatus according to claim 7, wherein the shield member moves in a direction intersecting a direction of the airflow from the supply unit.

12. The image forming apparatus according to claim 11, wherein the direction in which the mechanism moves is orthogonal to the direction of the airflow from the supply unit.

13. The image forming apparatus according to claim 7, wherein the shield member moves in a direction parallel to a sheet end direction on a side of the stack of sheets which receive the air flow.

14. The image forming apparatus according to claim 7, wherein shield member moves so that a side of the shield member facing the sheet stack moves in a direction parallel to the a sheet end direction on a side of the stack of sheets which receive the air flow.

* * * * *